US005878736A

United States Patent [19]

Lotuaco, III

[11] Patent Number: 5,878,736

[45] Date of Patent: Mar. 9, 1999

[54] DUAL-PRESSURE ELECTRONIC PAINTBALL GUN

[75] Inventor: Nicanor D. Lotuaco, III, Virginia Beach, Va.

[73] Assignee: Brass Eagle, Inc., Rogers, Ark.

[21] Appl. No.: 105,051

[22] Filed: Jun. 26, 1998

[51] Int. Cl.[6] ..... F41B 11/00

[52] U.S. Cl. ..... 124/71; 124/73; 124/75; 124/82

[58] Field of Search ..... 124/71, 72, 73, 124/75, 82

[56] References Cited

U.S. PATENT DOCUMENTS

| | | | |
|---|---|---|---|
| 4,936,282 | 6/1990 | Dobbins et al. | 124/74 |
| 5,462,042 | 10/1995 | Greenwell | 124/73 |
| 5,497,758 | 3/1996 | Dobbins et al. | 124/73 |
| 5,505,188 | 4/1996 | Williams | 124/74 |
| 5,542,406 | 8/1996 | Oneto | 124/73 |
| 5,572,982 | 11/1996 | Williams | 124/74 |
| 5,630,406 | 5/1997 | Dumont | 124/56 |
| 5,673,679 | 10/1997 | Walters | 124/53.5 |
| 5,755,213 | 5/1998 | Gardner, Jr. et al. | 124/73 |
| 5,778,868 | 7/1998 | Shephard | 124/76 |

*Primary Examiner*—J. Woodrow Eldred
*Attorney, Agent, or Firm*—Banner & Witcoff, Ltd.

[57] ABSTRACT

A gas-powered paintball gun has two pressure regulators which supply two different gas pressures for gun operation: a lower-pressure gas for quickly but gently loading balls into the chamber of the gun, and a high-pressure gas for consistently and efficiently propelling balls out of the barrel. A further aspect of the invention resides in the arrangement of the bolt under a removable cover, which gives easy access to the bolt, the breech and the barrel to enable these parts to be cleaned without major disassembly of other parts of the gun.

21 Claims, 5 Drawing Sheets

DUAL-PRESSURE ELECTRONIC PAINTBALL GUN

This application discloses and claims subject matter that is disclosed in copending provisional application Ser. No. 60/051,060, filed Jun. 27, 1997.

BACKGROUND

This invention relates to gas-powered guns for firing projectiles of the paintball type.

Paintball guns, which typically are used for target practice and in mock war games, use a pressurized gas source, such as $CO_2$, nitrogen or air, to propel projectiles (paintballs) out of the gun barrel. Paintballs typically comprise an admixture of approximately 92% ethylene glycol, 6% water and 2% titanium dioxide, encased in a fragile gelatin casing. The paintballs are designed to rupture upon impact to mark the target.

One typical problem with existing paintball guns is the tendency of balls to break while still in the gun, with its attendant mess and potential for clogging the gun. Ball breakage apparently is due to excessive bolt impact or gas pressure forces on the ball. Another problem is the difficulty of accessing the chamber, the barrel and the bolt of the gun in order to clean them. Yet another problem is inaccuracy due to inconsistent paintball velocity, apparently due to fluctuations in the pressure of the gas used to propel the balls.

SUMMARY OF THE INVENTION

This invention solves these problems by providing an electronically controlled paintball gun wherein two pressure regulators are used. One pressure regulator supplies a constant high-pressure source of gas for consistently and efficiently propelling paintballs out of the barrel. The other pressure regulator supplies a constant lower-pressure source of gas which allows for a fast cyclic rate for breech loading of paintballs without excessive, ball-crushing force. Further, an easily removable bolt cover is provided at the rear of the upper receiver. When the cover is removed, the bolt easily can be removed, giving easy access to the bolt, the breach and the barrel for cleaning purposes.

Thus, in accordance with one aspect of the invention, a gas-powered gun is provided for firing balls dispensed serially from a magazine into the gun, the gun adapted to be connected to a source of pressurized gas and having trigger-activated valving for controlling the flow of gas within the gun, a barrel with a chamber at the rear thereof, a breech behind the chamber for receiving one ball at a time through a ball feed port from the magazine, and a bolt slidable within the breech and the chamber to advance a ball from the breech into the chamber and close off the feed port so that gas pressure behind the ball forces the ball out of the front of the barrel. A high-pressure regulator supplies gas to the chamber at a substantially constant relatively high pressure to force the ball out of the barrel, while a low-pressure regulator supplies gas at a substantially constant relatively lower pressure for moving the bolt forwardly to advance a ball into the chamber.

In accordance with another aspect of the invention, a gas-powered gun is provided for firing balls dispensed serially from a magazine into the gun, the gun having a barrel with a chamber at the rear thereof, a breech behind the chamber for receiving one ball at a time through a ball feed port from the magazine, and a bolt slidable within the breech and the chamber to advance a ball from the breech into the chamber and close off the feed port so that gas pressure behind the ball forces the ball out of the front of the barrel. A bolt cover partially forms the breech and is removably secured to the rear of the gun behind the ball feed port. Removal of the bolt cover exposes the bolt and allows the bolt to be disengaged and removed from the gun, thereby facilitating cleaning of the bolt, the breech, the chamber and the barrel.

DETAILED DESCRIPTION

Figure 1:
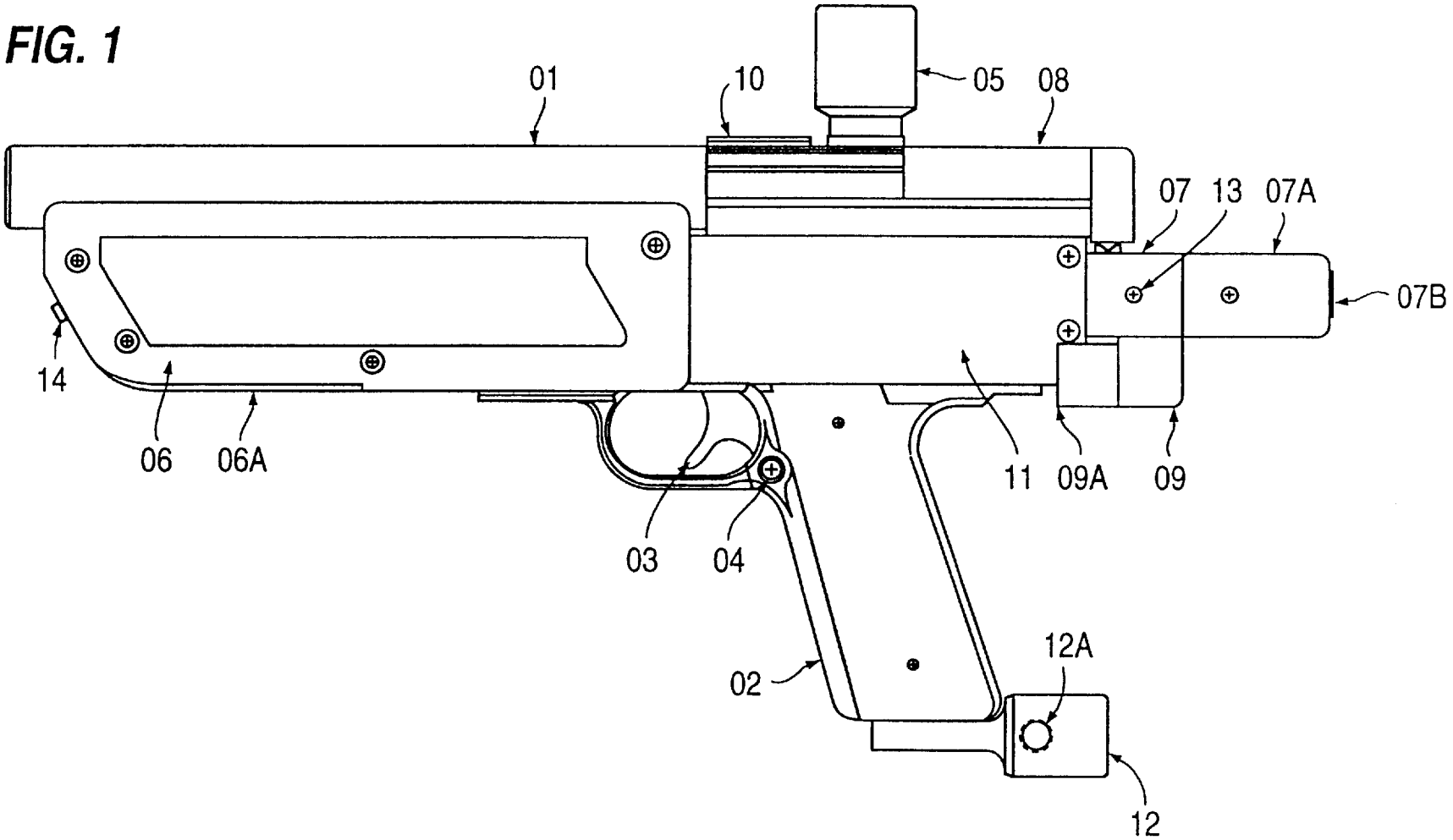
FIG. 1 is a side elevational view of a paintball gun according to the invention.

Referring to FIG. 1, a paintball gun according to the invention has the following external features: a barrel 01; a grip 02; a trigger 03; a safety 04; a ball feed port 05; a foregrip 06 with a battery access door 06A; a regulator 07; an upper cover 08; a low-pressure regulator 09; an upper receiver 10; a constant gas adaptor 12; and an on/off switch 14.

A constant gas source is applied to the gun by means of a tank (usually $CO_2$ or nitrogen or compressed air) threaded into the opening of the constant gas adaptor 12. The pressurized gas is transported through opening 12A by means of a high pressure hose assembly (not shown) into opening 13 of regulator 07. Once the switch 14 is turned on and the safety 04 is moved to the "fire" (off) position, the gun is ready to fire by pulling rearwardly on trigger 03.

Paintballs B are loaded into the ball feed port 05 from a hopper (not shown) which can contain many paintballs, and which are gravity-fed into the breech at the rear of barrel 01. Paintball velocity can be adjusted by adjusting the gas pressure, i.e., by turning the regulator adjustment screw 07B by use of a "Allen" key tool (not shown). Gas pressure for propelling paintballs is regulated to 450–500 psi by regulator 07. This regulator (see FIG. 2A) has a spring pack 15 in a housing 07A, a disk 16, a piston 17 held in place by a retaining ring 18, and a shaft 19, which is biased rearwardly by a coil spring 20. Unregulated pressurized gas enters the chamber surrounding shaft 19 via opening 13 (not shown in these figures). Output pressure is governed by the position of adjustment screw 07B, which controls the degree of compression (and, hence, the spring constant) of spring pack 15. Gas flows outwardly from pressure regulator 07 through port 22A, and branches forwardly through bore 22B to a high pressure chamber 15A adjacent valve mechanism 43, 44, 45, and downwardly through bore 22C to low-pressure regulator 9.

When output pressure is stabilized (i.e., before the gun is fired), the conical part of shaft 19 seals against annular face seal 21, which is held in place by a threaded retainer 22.

When the gun is fired, gas pressure in the region between retainer 22 and piston 17 drops, allowing spring pack 15 to push shaft 19 forwardly and out of engagement with seal 21. As gas flows again into the region between retainer 22 and piston 17, gas pressure moves the piston rearwardly against the force of spring pack 15, pulling shaft 19 with it until the conical part of the shaft again contacts seal 21.

Figure 2:
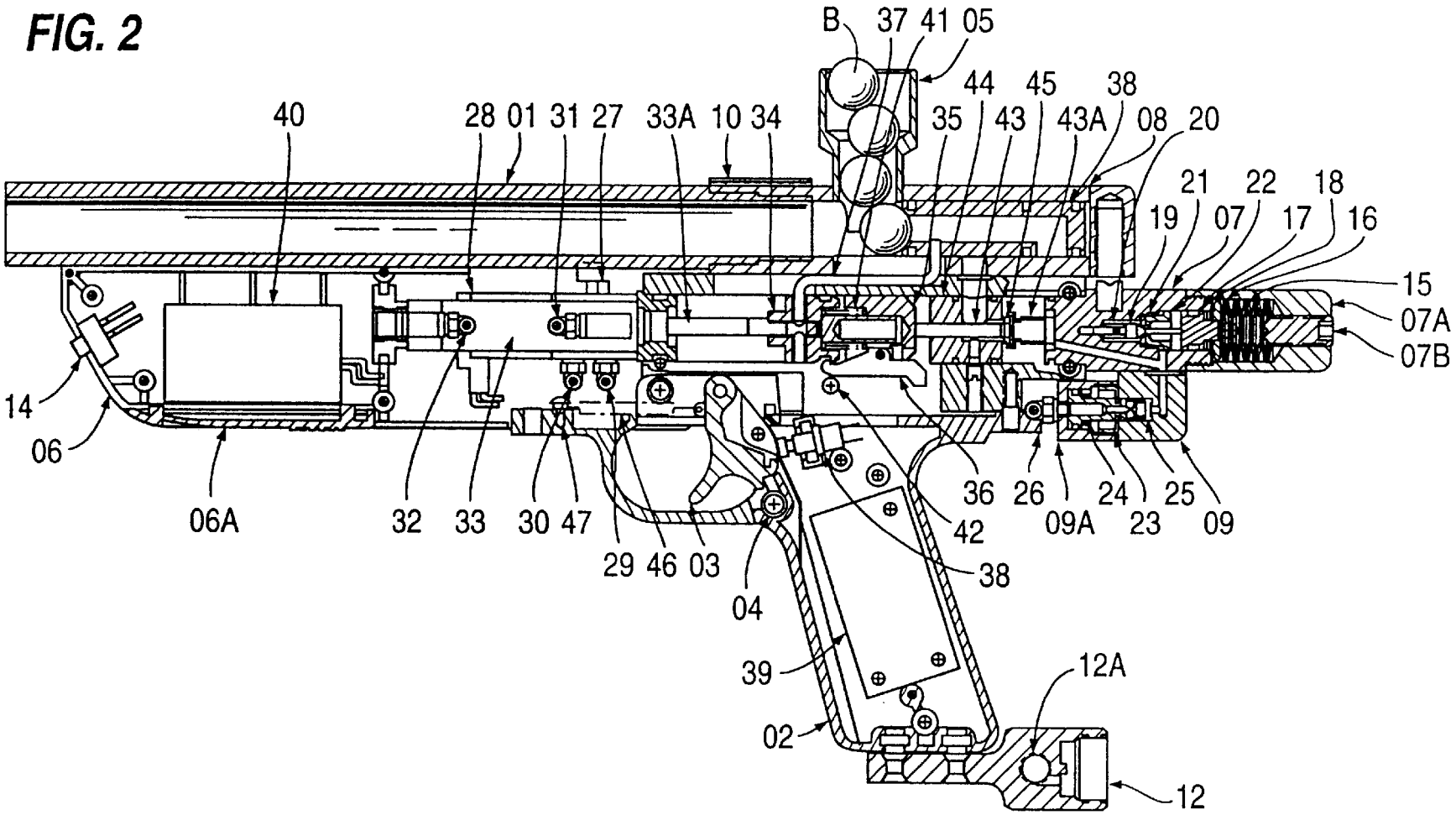
FIG. 2 is longitudinal cross-sectional view through the gun of FIG. 1, showing the gun in its "ready to fire" condition.
Figure 2A:
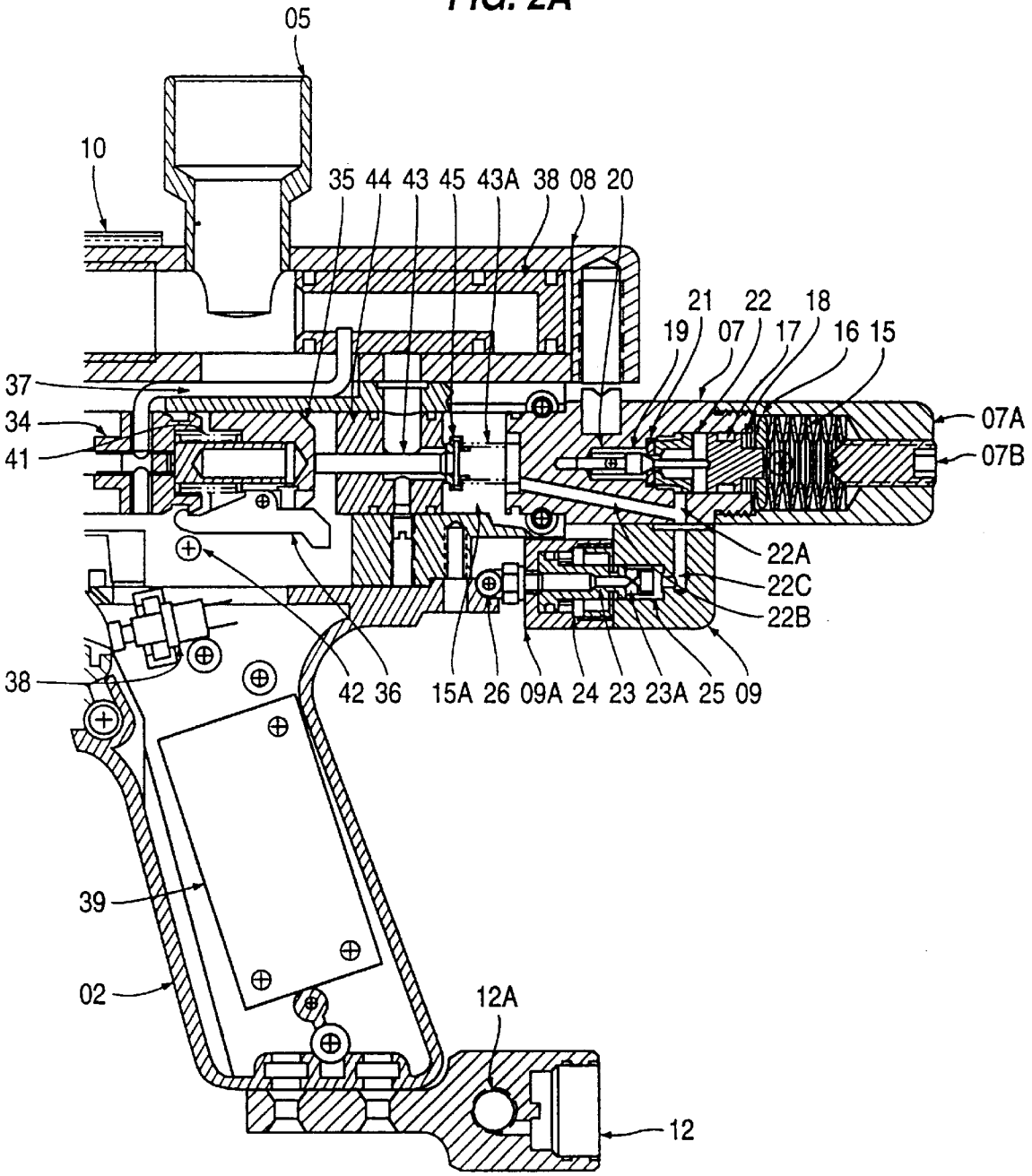
FIG. 2A is an enlarged view of the rear end of the gun as seen in FIG. 2.

Referring further to FIG. 2A, the low-pressure regulator 09 supplies lower-pressure gas via output 26 for actuation of the valve which quickly but gently cycles bolt 38 to push one paintball B at a time from the breech into the chamber at the rear of barrel 01. Low-pressure regulator 09 is comprised of a hollow piston 23, a coil spring 24 and a seal 25, all contained within a housing 9A. Gas entering low-pressure regulator 09 from regulator 07 via bore 22C flows around seal 25 and into the interior of piston 23 via cross-bores 23A. Under static downstream conditions (i.e., before the gun is fired), gas pressure within and forwardly of piston 23 overcomes the force of spring 24 to urge the piston rearwardly until seal 25 contacts the seat at the rear end of the regulator to close off gas flow. This arrangement provides a constant lower pressure at output port 26, preferably in the range of 150–200 psi.

Referring to FIG. 2, the output of low-pressure regulator 09 feeds into the input port 27 of a 4-way solenoid valve 28 via a hose or conduit (not shown). Solenoid valve 28 controls the flow of gas to double-acting pneumatic cylinder 33, which has a piston rod 33A. On the end of rod 33A is a carrier 34 which in the position shown is connected to a hammer 35 by means of a sear 36, which is pivoted at 36A on the hammer. A coil hammer spring 41 between carrier 34 and hammer 35 normally biases these two parts away from each other. Carrier 34 also holds a link 37 which attaches the carrier to bolt 38 which slides in upper receiver 08. The valve is in a normally-open condition such that the gas feeds into cylinder 33 through port 32, causing rod 33A of the cylinder to extend rearwardly. This rearmost position of the rod, carrier, hammer, link and bolt, illustrated in FIG. 2, is the "ready-to-fire" position.

The gun is controlled electronically by a circuit board 39 housed in grip 02. The circuit board is powered by batteries (4 "AA" size batteries in this case), which are housed in battery pack 40 in foregrip 06, and accessible through battery access door 06A. On/off switch 14, located at the front of foregrip 06, controls the delivery of electrical power from the batteries to the circuit board.

Figure 3:
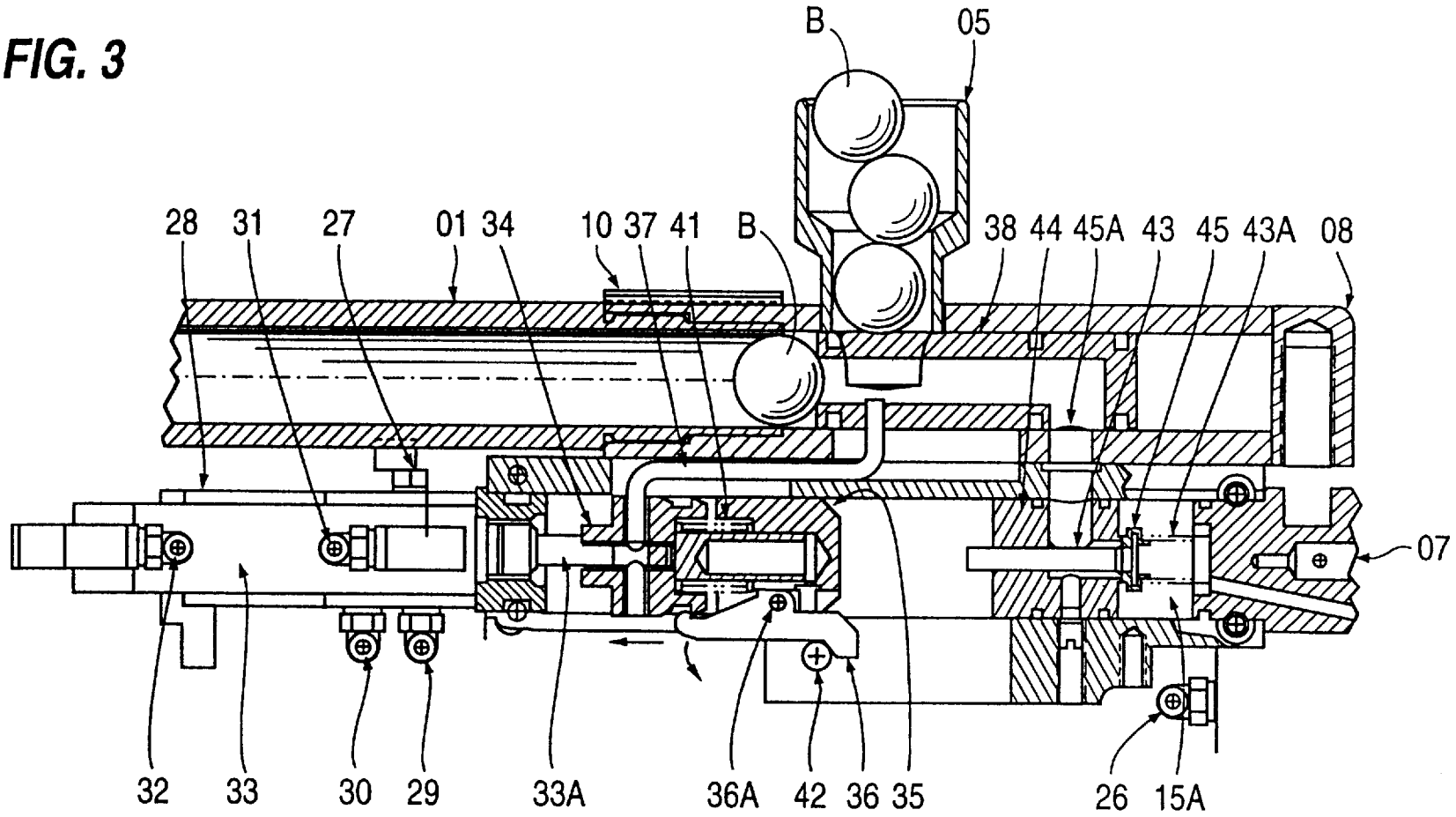
FIG. 3 is a longitudinal cross-sectional view of the working parts of the gun, shown in the condition where a paintball has been loaded into the chamber and is ready to be propelled out of the barrel.

With on/off switch in the "on" position, when trigger 03 is pulled it depresses and closes switch 34, which sends a signal to the circuit board 39. The circuit board, upon receiving the trigger signal, sends a signal to the 4-way valve 28 to close off 4-way output port 29 and open flow to 4-way output port 30 for a pre-set interval (approximately 70 ms) dictated by the circuit board. Flow of lower-pressure gas through output port 30, connected to cylinder port 31 via a hose or conduit (not shown), causes rod 33A to move forwardly quickly but gently, bringing with it carrier 34, link 37, bolt 38, hammer 35, hammer spring 41, and sear 36. This forward movement gently advances a paintball B ahead of the bolt from the breech into the chamber at the rear of barrel 01. The forward position of these components is illustrated in FIG. 3.

Figure 4:
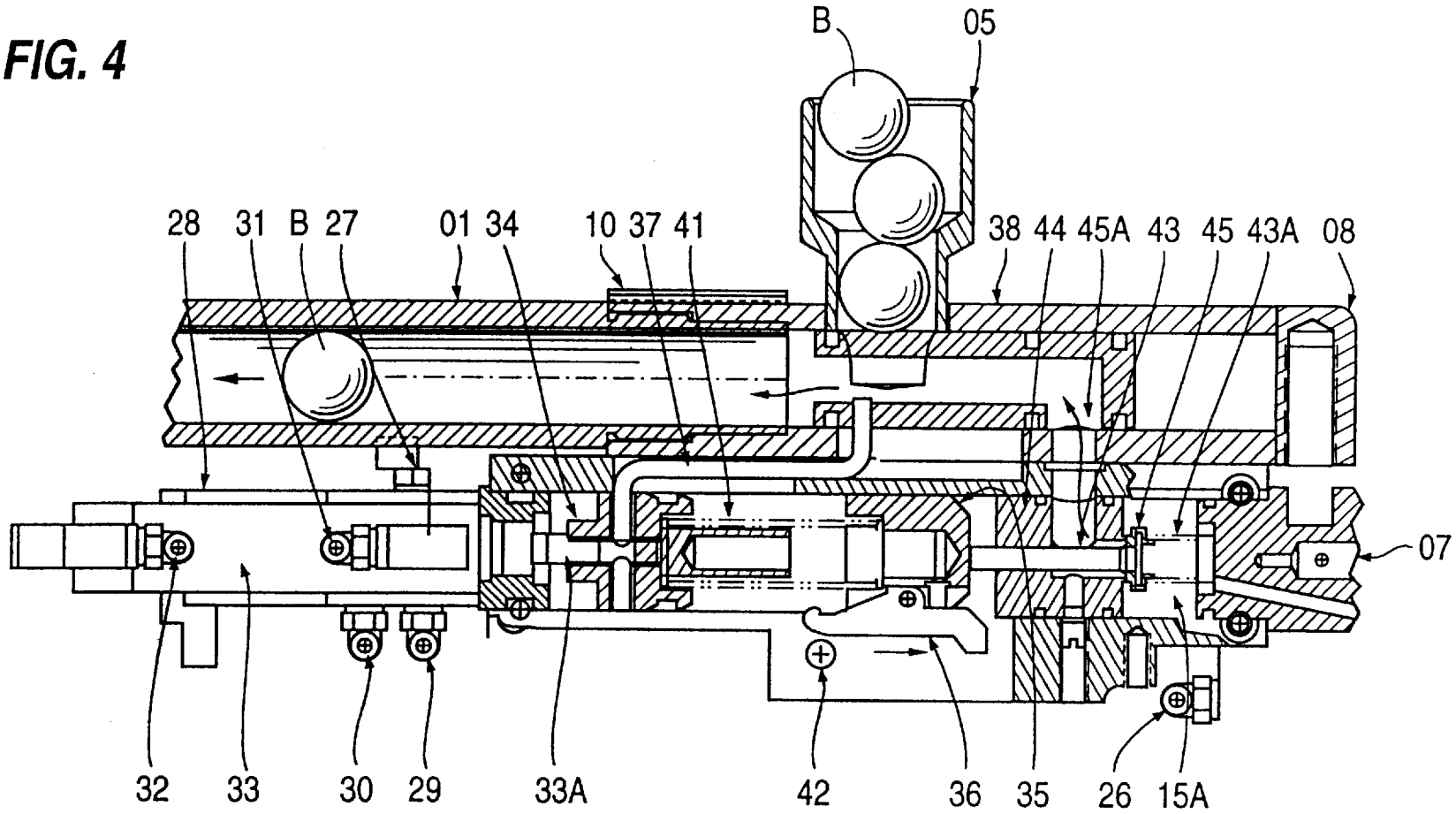
FIG. 4 is an enlarged cross-sectional view of the same working parts of the gun, shown in the condition where high-pressure gas is being delivered to the chamber to drive the paintball out of the barrel.

As these forwardly moving components near the end of their travel, the depending rear leg of sear 36 engages fixed roller pin 42. See FIG. 3. Further incremental forward movement of the components causes sear 36 to rotate about its pivot 36A (counterclockwise in FIG. 3) so that its front end moves downwardly and disengages from carrier 34. As carrier 34 continues to move forwardly, the hammer/sear assembly 35/36, being disconnected from the carrier, is thrust rearwardly by hammer spring 41. See FIG. 4. Hammer 35 strikes valve shaft 43, which is slidably retained in valve body 44 and biased forwardly by spring 43A. This causes valve shaft 43 to move rearwardly momentarily, dislodging seal 45 from its seat and allowing high pressure gas to flow from high pressure chamber 15A around the seal, into valve body 44, and up through the opening (inlet port) 45A in bolt 38. At this time, with the bolt forward and a paintball at the rear of the barrel 01, the bolt closes off feed port 05, preventing another ball from loading into the chamber and preventing the escape of gas. The high pressure gas flowing through bolt 38 pushes the ball through the barrel and out the muzzle end.

Once the 70 ms interval ends, circuit board 39 de-energizes the signal to 4-way valve 33, closing output port 30 and return gas flow to output port 29. This causes piston rod 33A to move rearwardly again until sear 36 again couples carrier 34 to hammer 35. Trigger 03 then is released, allowing it to move back to its initial position under the influence of trigger spring 46. The gun thus has returned to the "ready-to-fire" condition (FIG. 2), and will not fire until the trigger is pulled again. The gun will remain in this condition even if the on/off switch 14 is turned off and/or the gas source is removed from the gun.

For ease of cleaning bolt 38 and barrel 1, especially in the breech area, upper cover 8 is slidably secured to upper receiver 10, and easily can be removed by pulling it rearwardly. Removal of upper cover 8 exposes bolt 38, which then can be lifted out of the gun.

The trigger force can be adjusted (e.g., light pull or hard pull) either by changing trigger spring 46, or by changing the position of spring anchoring point 47.

It will be apparent to those skilled in the art that modifications may be made to the above-described preferred embodiment without departing from the true spirit and scope of the invention, which is defined by the appended claims.

I claim:

1. In a gas-powered gun for firing balls dispensed serially from a magazine into the gun, the gun adapted to be connected to a source of pressurized gas and having trigger-activated valving for controlling the flow of gas within the gun, a barrel with a chamber at the rear thereof, a breech behind the chamber for receiving one ball at a time through a ball feed port from the magazine, and a bolt slidable within the breech and the chamber to advance a ball from the breech into the chamber and close off the feed port so that gas pressure behind the ball forces the ball out of the front of the barrel, the improvement comprising:

a high-pressure regulator for supplying gas to said chamber at a substantially constant relatively high pressure to force the ball out of said barrel; and a low-pressure regulator for supplying gas at a substantially constant relatively lower pressure for moving said bolt forwardly to advance a ball into said chamber.

2. A gun according to claim 1 wherein said regulators are in serial fluid communication, with the input side of said low-pressure regulator receiving relatively high-pressure gas from the output side of said high-pressure regulator.

3. A gun according to claim 1 wherein said regulators are located at the rear of the gun.

4. A gun according to claim 3 wherein said low-pressure regulator is located below said high-pressure regulator.

5. A gun according to claim 1 further comprising a pneumatic cylinder in fluid communication with said low-pressure regulator and having a piston rod mechanically linked to said bolt for moving said bolt under the influence of said lower-pressure gas.

6. A gun according to claim 5 wherein said pneumatic cylinder is a double-acting pneumatic cylinder which moves said bolt forwardly and rearwardly.

7. A gun according to claim 6 wherein said valving comprises a trigger-activated multi-way solenoid valve and a control circuit which controls the flow of said lower-pressure gas into said pneumatic cylinder.

8. A gun according to claim 7 wherein when said trigger is depressed, said control circuit causes said solenoid valve and said pneumatic cylinder to drive said rod forwardly for a predetermined interval of time to allow the ball to be advanced into said chamber and be fired, and thereafter to drive said rod rearwardly to return said bolt to its rearmost position.

9. A gun according to claim 7 wherein said pneumatic cylinder is located below the axis of said barrel, chamber and breech, and said rod moves parallel to said bolt.

10. A gun according to claim 9 further comprising a carrier attached to and movable coaxially with said rod, and a link interconnecting said carrier and said bolt.

11. A gun according to claim 6 wherein said pneumatic cylinder is located below the axis of said barrel, chamber and breech, and said rod moves parallel to said bolt.

12. A gun according to claim 11 further comprising a carrier attached to and movable coaxially with said rod, and a link interconnecting said carrier and said bolt.

13. A gun according to claim 12 wherein said bolt is hollow with an opening at its front end which is smaller than the diameter of a ball, a blind rear end, and an inlet port in its bottom surface for admitting said relatively high-pressure gas into the interior thereof when the gun is fired.

14. A gun according to claim 13 wherein said breech has a high-pressure gas port in the bottom thereof in fluid communication with said high-pressure regulator, said high-pressure gas port and said inlet port being located relative to one another such that they are in registry only when said bolt has moved forwardly to advance a ball into said chamber and close said ball feed port.

15. A gun according to claim 14 further comprising:

a high-pressure gas valve for controlling the flow of said relatively high-pressure gas to said high-pressure gas port, said high-pressure gas valve having a forwardly protruding valve stem coaxial with said carrier;

a hammer behind and movable coaxially of said carrier;

a hammer spring between and urging apart said carrier and said hammer;

a sear pivoted to said hammer and engageable with said carrier to releasably lock said hammer and said carrier together so that they can move as a unit; and a fixed abutment engageable by said sear near the forward end of its travel to pivot said sear out of engagement with said carrier, whereby when the gun is fired, said rod moves forwardly and carries with it said carrier, said hammer, said link and said bolt to advance a ball into said chamber and close off said ball feed port and, when said sear then encounters said abutment, said hammer is released from said carrier and is thrust rearwardly by said hammer spring to strike said valve stem and momentarily open said high-pressure gas valve to allow said relatively high-pressure gas to enter said bolt and propel said ball out of said barrel.

16. A gun according to claim 15 wherein said valving comprises a trigger-activated multi-way solenoid valve and a control circuit which controls the flow of said lower-pressure gas into said pneumatic cylinder.

17. A gun according to claim 16 wherein when said trigger is depressed, said control circuit causes said solenoid valve and said pneumatic cylinder to drive said rod forwardly for a predetermined interval of time to allow the ball to be advanced into said chamber and fired, and thereafter to drive said rod rearwardly to return said carrier and said bolt to their rearmost positions and cause said sear to reengage said carrier.

18. A gun according to claim 17 further comprising a bolt cover partially forming said breech and removably secured to the rear of the gun behind said ball feed port, said bolt cover, when removed, exposing said bolt and allowing said bolt to be disengaged from said link and removed from the gun, thereby facilitating cleaning of said bolt, said breech, said chamber and said barrel.

19. A gun according to claim 18 wherein said bolt cover is slidably retained on the gun.

20. A gun according to claim 5 further comprising a bolt cover partially forming said breech and removably secured to the rear of the gun behind said ball feed port, said bolt cover, when removed, exposing said bolt and allowing said bolt to be disengaged from said rod and removed from the gun, thereby facilitating cleaning of said bolt, said breech, said chamber and said barrel.

21. A gun according to claim 1 further comprising a bolt cover partially forming said breech and removably secured to the rear of the gun behind said ball feed port, said bolt cover, when removed, exposing said bolt and allowing said bolt to be disengaged from said link and removed from the gun, thereby facilitating cleaning of said bolt, said breech, said chamber and said barrel.

* * * * *

UNITED STATES PATENT AND TRADEMARK OFFICE

CERTIFICATE OF CORRECTION

PATENT NO. : 5,878,736
DATED : March 9, 1999
INVENTOR(S) : Nicano D. Lotuaco, III It is certified that error appears in the above-identified patent and that said Letters Patent is hereby corrected as shown below:

On the title page:

After "[22] Filed: Jun. 26, 1998" insert item [60] based on Provisional Application No. 60/051,060 Filed: Jun. 27, 1997--

Signed and Sealed this

Fifth Day of October, 1999

*Attest:*

Q. TODD DICKINSON

*Attesting Officer*

*Acting Commissioner of Patents and Trademarks*